US008215135B2

(12) United States Patent
Hapke et al.

(10) Patent No.: US 8,215,135 B2
(45) Date of Patent: Jul. 10, 2012

(54) APPLIANCE LATCH WITH POWER FAILURE UNLOCK

(75) Inventors: Kenyon A. Hapke, Libertyville, IL (US); Michael S. Osvatic, Waukesha, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 903 days.

(21) Appl. No.: 12/054,872

(22) Filed: Mar. 25, 2008

(65) Prior Publication Data

US 2008/0256999 A1 Oct. 23, 2008

Related U.S. Application Data

(60) Provisional application No. 60/925,597, filed on Apr. 20, 2007.

(51) Int. Cl.
*D06F 33/02* (2006.01)
*D06F 37/42* (2006.01)

(52) U.S. Cl. ..... 68/12.26; 210/146; 134/57 DL

(58) Field of Classification Search ..... 68/12.26, 68/23 R, 196; 134/57 D, 57 DL, 56 D, 58 D, 134/58 DL, 200; 210/146; 192/135, 136; 292/DIG. 66, DIG. 69
See application file for complete search history.

(56) References Cited

U.S. PATENT DOCUMENTS

| | | | | |
|---|---|---|---|---|
| 5,520,424 | A | 5/1996 | Hapke et al. | |
| 5,572,869 | A | 11/1996 | Schantz et al. | |
| 5,823,017 | A * | 10/1998 | Hapke et al. | 68/12.26 |
| 6,363,755 | B1 | 4/2002 | Hapke et al. | |
| 6,840,553 | B2 * | 1/2005 | Dirnberger et al. | 292/341.16 |
| 6,886,868 | B2 | 5/2005 | Hengelein et al. | |
| 6,940,373 | B2 | 9/2005 | Hintz et al. | |
| 7,251,961 | B2 * | 8/2007 | Hapke et al. | 68/12.26 |
| 7,493,783 | B2 * | 2/2009 | Hapke et al. | 68/12.26 |
| 7,617,703 | B2 * | 11/2009 | Osvatic | 68/12.26 |
| 7,900,979 | B2 * | 3/2011 | Bragg et al. | 292/137 |
| 2005/0122194 | A1 * | 6/2005 | Hintz et al. | 335/220 |

FOREIGN PATENT DOCUMENTS

| | | | |
|---|---|---|---|
| DE | 3423083 | A1 * | 1/1986 |
| DE | 198 08 848 | A1 | 10/1998 |

OTHER PUBLICATIONS

DE 3423083 A1; Jan. 1986; Germany; Huettemann, Wilfried Dipl; Machine Translation (English).*
International Search Report and Written Opinion of the International Searching Authority for PCT/US2008/059536.

* cited by examiner

*Primary Examiner* — Joseph L Perrin
(74) *Attorney, Agent, or Firm* — Boyle Fredrickson, S.C.

(57) ABSTRACT

A lock for a washing machine or the like provides fast actuation through a solenoid driven bolt that remains stably in the locked position after power is no longer applied to the solenoid. The possibility of power failure preventing subsequent access to the washing machine is avoided through the use of a slower actuation time, thermal actuator storing sufficient energy to unlock the bolt after a time delay when power is lost.

16 Claims, 3 Drawing Sheets

APPLIANCE LATCH WITH POWER FAILURE UNLOCK

CROSS-REFERENCE TO RELATED APPLICATIONS

This application claims the benefit of U.S. Provisional Application 60/925,597, filed Apr. 20, 2007, the disclosure of which is incorporated herein by reference.

STATEMENT REGARDING FEDERALLY SPONSORED RESEARCH OR DEVELOPMENT

--

BACKGROUND OF THE INVENTION

The present invention relates to latching mechanisms for the doors of appliances such as clothes washing machines and, in particular, to an electrically actuated lock for such latching mechanisms.

Appliances, such as clothes washing machines and dishwashers, may operate automatically through one or more cycles under the control of a timer. During cycles when the consumer might be exposed to spraying water or hazardous moving parts, the door to the appliance may be locked by an electrical signal from the timer. The locking mechanism may, for example, insert a blocking member into a portion of the door latch to prevent the latch from opening, or the locking mechanism may insert a bolt directly between the appliance frame and door.

One method of actuating the locking mechanism is to use a thermal actuator, for example, a wax motor or bi-metallic strip. Such thermal actuators have the disadvantage of requiring a heating or cooling of a material. This heating or cooling process typically takes some time, preventing rapid locking or unlocking of the locking mechanism.

An alternative method of actuating the locking mechanism is to use an electrical solenoid having a ferromagnetic armature that moves through a conductive coil when electrical power is applied to the coil to form an electromagnet. Electrical solenoids provide for rapid actuation but at a cost of increased size and expense, particularly if the coil windings, the latter of which normally must be rated for continuous duty to maintain the locking mechanism in its locked or unlocked state. The use of continuous duty solenoids in locks can also create a problem in the event of a electrical power loss, caused either by an electrical outage, or the appliance being unplugged, where the end user will have access to the inside of the washer while the drum is still spinning. The disadvantages inherent in the use of a continuous duty solenoid can be overcome through the use of an electromagnetically pulsed bi-stable solenoid. A bi-stable solenoid may include a magnetized armature movable in different directions by different polarities of current through a single solenoid coil, a pair of back to back independent solenoid coils passing a ferromagnetic armature between them when one or the other is energized, or a single solenoid activating a mechanism that cycles between two states with each activation. The bi-stable solenoid may be coupled with an over-center spring or the like to hold the armature in its last position when no power is applied or during a power loss.

Such bi-stable solenoids provide rapid actuation and overcome the power dissipation problems inherent with continuous duty solenoids. When used in a locking application, however, they have an important shortcoming. In the event of a loss of electrical power, the door latch may be locked indefinitely because no power is available to move the bi-stable solenoid to its unlocked state. This is an important problem in commercial laundry establishments where, in the event of power failure, customers will not be able to collect their clothes and yet may be reluctant to leave their clothes unattended.

U.S. Pat. No. 6,363,755 to Hapke et al issued Apr. 2, 2002 and entitled "Timed Release Washing Machine Lid Lock" describes a circuit that holds energy in a capacitor to be used to unlock a bi-stable lock mechanism at the end of a spin cycle even if power has been lost. This approach, while extremely flexible, requires an additional electrical circuit and a capacitor sized to store sufficient energy, which can be expensive.

U.S. Pat. No. 5,572,869 to Schantz et al issued Nov. 12, 1996 and entitled "Actuator Assembly for use in Appliances" describes a "wax motor" that uses an internal heating element to generate a force and displacement. This device stores energy within a compression spring that can be used to deliver a secondary force and displacement (in the opposite direction) after electrical power is removed and upon cooling of the heating element (which occurs after some time delay).

BRIEF SUMMARY OF THE INVENTION

The present invention provides latching mechanism that employs a bi-stable solenoid for rapid locking and unlocking of an appliance door while storing energy to unlock the appliance door in the event of power failure in a separate thermal actuator. The thermal actuator may have improved costs and power consumption qualities over a continuous duty solenoid.

Specifically, the present invention provides a door locking assembly for use in an appliance receiving electrical power from a power line and having a door that may be opened to provide access to a wash chamber. The door locking assembly includes a bi-stable electromagnetic locking mechanism which, in a locked state, holds the door closed until an electrical unlock signal is received and, in an unlocked state, allows the door to be freely opened until an electrical lock signal is received. The electromagnetic locking mechanism is capable of remaining stably in the locked state or unlocked state absent application of the electrical unlock signal or the electrical lock signal. A thermal actuator communicates with the bi-stable electromagnetic locking mechanism to: (1) store energy while the power line provides electrical power, (2) use the stored energy to unlock the bi-stable electromagnetic locking mechanism when the bi-stable electromagnetic locking mechanism is in a locked state and power is lost at the power line, and (3) provide a time delay period, to allow the appliance to come to a standstill, before the thermal actuator cools to a point where an unlock status is initiated.

Thus it is an object of one embodiment of the invention to provide the high-speed and low power consumption of a bi-stable actuator while preventing a lockout in the event of power failure.

The thermal actuator may store energy only while the power line provides electrical power and a separate activation signal related to the electrical lock signal is received from a cycle timer.

It is thus an object of one embodiment of the invention to minimize energy dissipation in the thermal actuation element until lockout protection is required.

The thermal actuator may store energy before the electrical lock signal has been received.

Thus it is an object of one embodiment of the invention to eliminate the possibility of lockout when the thermal actuator is not fully heated and thus is not capable of providing an unlocking.

The stored energy may be held in a spring flexed by thermal expansion of a material heated by electrical power terminating with loss of power from the power line and released after a predictable cool down period.

It is thus an object of one embodiment of the invention to monitor a power line power by the seating of a material with power line power.

The thermal actuator may be a wax motor.

It is thus an object of one embodiment of the invention to provide a low-cost, high force, and robust thermal actuator.

The wax motor may receive a voltage from the power line.

It is thus an object of one embodiment of the invention to eliminate the need for intermediate power conditioning circuits.

The thermal actuator may communicate with the bi-stable electromagnetic locking mechanism through a coupling providing engagement between the thermal actuator and the bi-stable electromagnetic locking mechanism during cooling of the thermal actuator when the electromagnetic locking mechanism is locked, and providing disengagement between the thermal actuator and the bi-stable electromagnetic locking mechanism at other times.

It is thus an object of one embodiment of the invention to provide unencumbered movement of the electromagnetic locking mechanism when power failure initiated unlocking is not required.

The coupling may provide a tooth and socket engaging each other when the thermal actuator has substantially fully stored energy and disengaging when the thermal actuator has substantially fully exhausted stored energy.

It is thus an object of one embodiment of the invention to provide a simple mechanical coupling mechanism.

The door locking assembly may further include an operator manually accessible from the outside of the door locking assembly and communicating with the bi-stable electromagnetic locking mechanism to move the bi-stable electromagnetic locking mechanism to an unlocked state when the operator is manually operated.

It is thus an object of one embodiment of the invention to provide for a manual override in the event of power failure or before connection of power.

The bi-stable electromagnetic locking mechanism may be a sliding bolt driven by a bi-stable solenoid. The bi-stable solenoid may comprise two electrically independent solenoid coils arranged in opposition about a common armature.

It is thus an object of one embodiment of the invention to employ a high-speed solenoid actuator made cost-effective by its ability to be used in a non-continuous mode.

The bi-stable electromagnetic locking mechanism includes a bi-stable bolt engaging a latch.

It is thus an object of one embodiment of the invention to permit an integrated latch lock assembly for improved manufacturing.

These particular features and advantages may apply to only some embodiments falling within the claims and thus do not define the scope of the invention.

DETAILED DESCRIPTION OF THE PREFERRED EMBODIMENT

Figure 1:
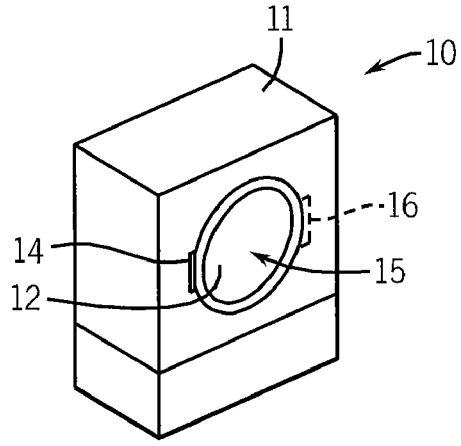
FIG. 1 is a simplified perspective view of a front-loading washing machine suitable for use with the present invention.

Referring now to FIG. 1, a front loading washing machine 10 may provide a cabinet 11, having at its front surface a door 12, the latter opening about a hinge 14 between an open and closed position to provide access to a washing chamber 15. The door 12 may be retained in the closed position (as shown) by a door locking assembly 16 having components within the cabinet 11 and attached to a rear face of the door 12.

Figure 2:
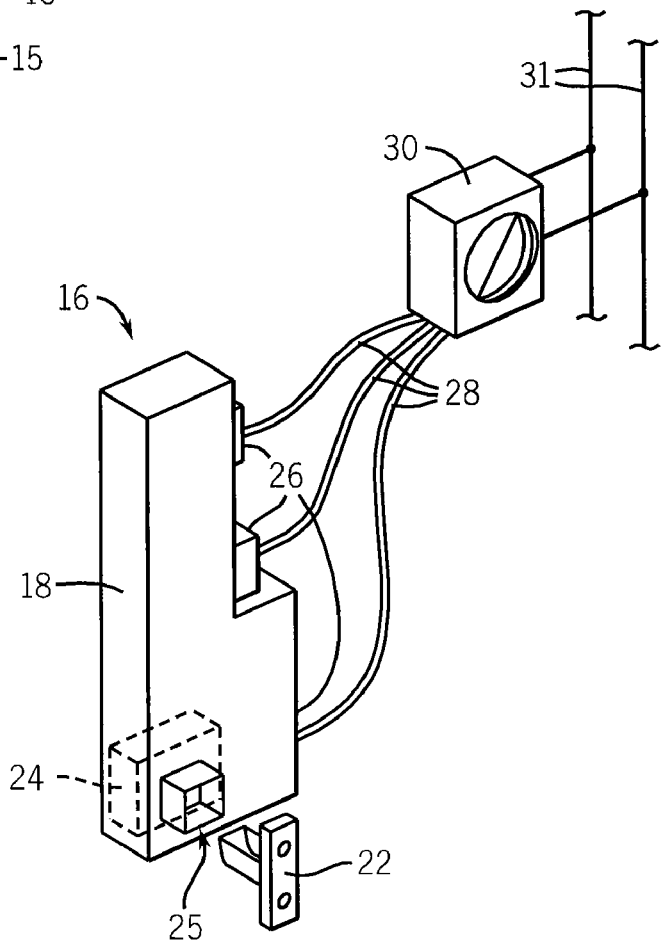
FIG. 2 is a perspective view of the door locking assembly of the present invention as may be incorporated into the housing of the washing machine of FIG. 1, also showing a latch tongue as attached to the door of the washing machine of FIG. 1 and received by the door locking assembly.

Referring now also to FIG. 2, the door locking assembly 16 may provide a housing 18 with an opening 25, a similar opening in the front surface of the cabinet 11 to receive a latch tongue 22 attached to the rear side of the door 12. The latch tongue 22 is releasably held by a latching assembly 24 within the housing 18. A latching assembly 24 suitable for this purpose is described in co-pending U.S. application Ser. No. 11/071,910 entitled: "Appliance Latch Having a Rotating Latch Hook Mounted on a Linear Slide" and U.S. patent application Ser. No. 11/684,287 entitled: "Low Power Consumption Lock for Appliance Lock", both assigned to the assignee of the present invention and hereby incorporated by reference.

Referring still to FIG. 2, the door locking assembly 16 may provide for connector elements 26 communicating with wiring harness 28 exchanging signals with a cycle timer assembly 30, the latter communicating with a power line 31 providing power, for example 110 VAC, powering the cycle timer assembly 30. The cycle timer assembly 30 may receive signals from the door locking assembly 16 and provide signals to the door locking assembly 16 both in the form of 110 VAC, and 12 VDC, as will be described further below.

Figure 3:
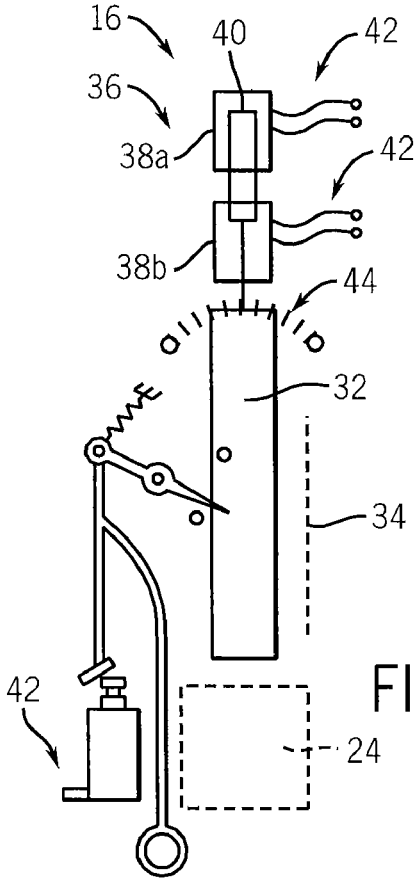
FIG. 3 is a simplified elevational view of the principal elements of the door locking assembly of FIG. 2 in an unlocked state.

Referring now to FIGS. 1 and 3, the door locking assembly 16 may provide for a locking bolt 32 that may slide along axis 34 under the influence of a bi-stable actuator 36. When the locking bolt 32 is in the upward position (as depicted) it is removed from the latching assembly 24 allowing the latching assembly 24 (and thus the door 12) to open and close normally under the control of a user of the washing machine 10. When the locking bolt 32 is in the downward position, it blocks the latching assembly 24 preventing the door 12 from opening.

The bi-stable actuator 36 may provide for two solenoid coils 38*a* and 38*b* arranged along the axis 34 and having an internal armature 40 that may be passed between them depending on which solenoid coil 38*a* or 38*b* is activated. The armature 40 is pulled into coil 38*a* upon receipt of a 110 VAC unlock signal at terminals 42 of the coil 38*a* from the cycle timer assembly 30. This flexes an over-center spring 44 stably holding the bolt 32 in the upward position even when power is removed from coil 38*a*. The bolt 32 is normally in this position before the washing machine 10 is started and after the washing machine 10 ends its cycles. Alternatively, the bi-stable actuator 36 may be a single solenoid coil (not shown) operating in either of two polarities with a permanent magnet internal armature.

Figure 4:
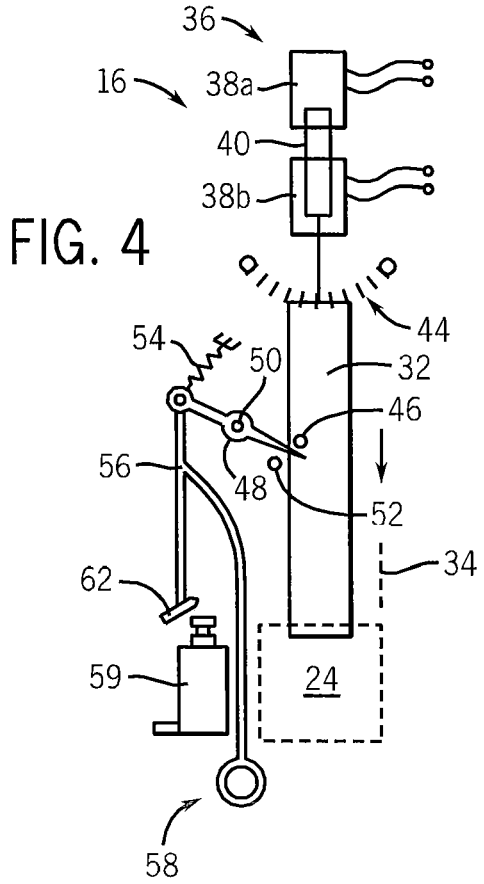
FIG. 4 is a figure similar to that of FIG. 3 showing the door locking assembly in a locked state as driven by a bi-stable solenoid.

Referring now to FIG. 4, a locking signal may be received by solenoid coil 38*b* from the cycle timer assembly 30 pulling the armatures 40 and bolt 32 downward (as depicted) causing the over-center spring 44 to snap downward holding the bolt 32 in that position even after removal of power of the unlocking signal in the coil 38*b*. As noted above, in this position the bolt 32 interferes with the latching assembly 24 preventing the door 12 from being opened by the user.

When the bolt 32 is in the locked position, an upwardly extending pin 46 on the bolt 32 moves proximate to a right end (as depicted) of an unlocking lever 48 pivoting about a pivot point 50 and held in an extreme clockwise position against the stop 52 by spring 54. A left end of the unlocking lever 48 opposite pivot point 50 with respect to the right end of the unlocking lever 48 is pivotally attached to an unlocking linkage 56 extending downward along axis 34. The unlocking linkage 56 is branched to provide a first branch extending outside of the housing 18 to a manual operator 58 that may be grasped by a person.

Figure 6:
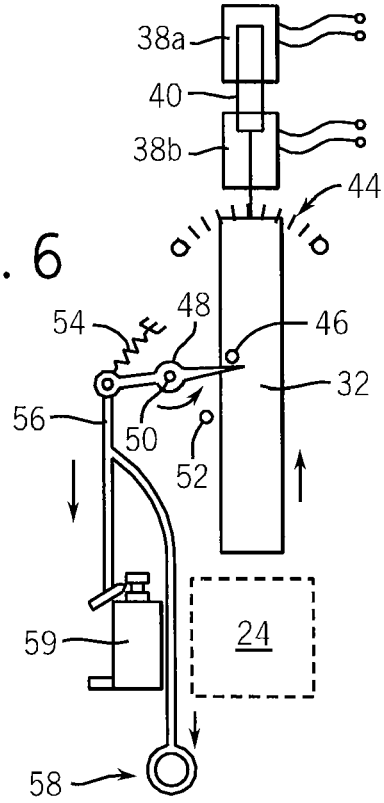
FIG. 6 is a figure similar to that of FIGS. 3-5 showing retraction of the thermal actuator upon power loss and cooling to unlock the door locking assembly.

As shown in FIG. 6, when the manual operator 58 is pulled, it rotates unlocking lever 48 in a counterclockwise direction pushing upward on pin 46 causing an axial retraction of the bolt 32 away from the latching assembly 24. Typically, the bolt 32 will rise further than the unlocking lever 48 under the influence of the over-center spring 44. The manual operator 58 thus allows a service person to unlock the washing machine 10 particularly before it has been attached to the power line 31. Pin 46, spring 54, unlocking lever 48 and unlocking linkage 56 together comprise an unlocking mechanism.

Figure 5:
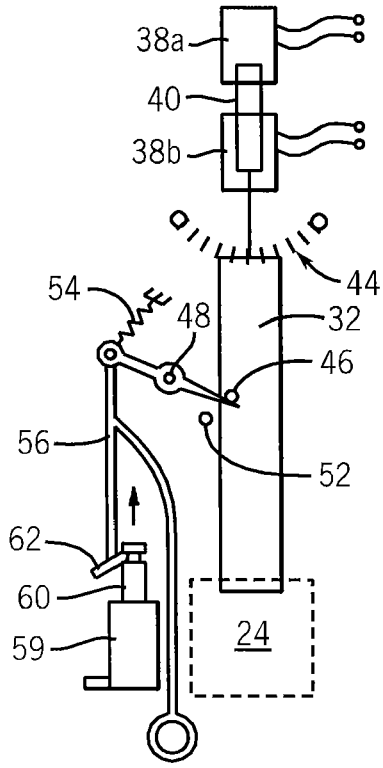
FIG. 5 is a figure similar to that of FIGS. 3 and 4 showing a thermal actuator engaging an unlocking mechanism when the thermal actuator is fully heated.

Referring now to FIG. 5, a wax motor 59 may receive line power from the cycle timer assembly 30 to heat internally contained wax whose expansion causes the extension of an operator 60 upward (as depicted) toward an angled tooth 62 attached to a second branch of the unlocking linkage 56. As is well understood in the art, the expansion of the wax pushes the operator 60 outward against the force of a contained spring that is increasingly flexed during that expansion.

Figure 7:
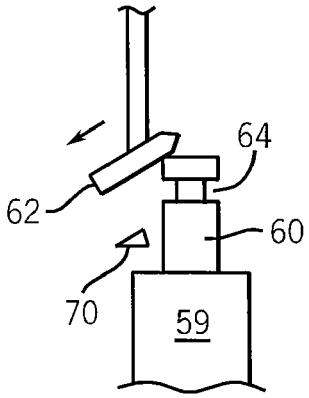
FIG. 7 is a detailed view of the thermal actuator of FIGS. 3-5 at an initial stage of heating before it is fully heated.

Referring now to FIG. 7, as operator 60 begins to rise (representing a state of partial heating of the wax motor 59) a bottom surface of the angled tooth 62 is pushed leftward (as depicted) by an upper surface of the operator 60.

Figure 8:
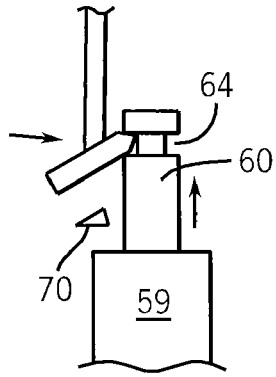
FIG. 8 is a figure similar to that of FIG. 7 showing the thermal actuator fully heated and engaging the unlocking mechanism.

Referring to FIG. 8, with increased extension of the operator 60 (representing a full heating of the wax motor 59) an inner edge of the angled tooth 62 moves over a slot 64 cut radially in the upper end of the operator 60 so that the right edge of the angled tooth 62 engages the slot 64. Note that over travel of the operator 60 upward may cause disengagement of the angled tooth 62, but that the angled tooth 62 will reengage with the slot 64 when the operator 60 retracts.

Figure 9:
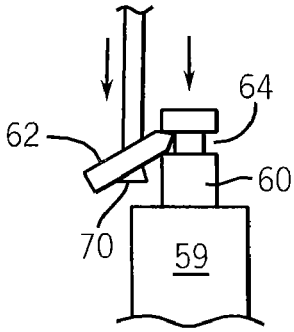
FIG. 9 is a figure similar to that of FIGS. 7-8 showing the thermal actuator in an initial stage of cooling after being fully heated and pulling back on the unlocking mechanism.

When power is removed from the wax motor 59, as shown in FIG. 9, the operator 60 moves downward driven by the inner spring of the wax motor 59 (not shown) and the contraction of the contained wax. As the operator 60 moves downward, it pulls with it the angled tooth 62 and the unlocking linkage 56 raising the bolt 32 as shown in FIG. 6 in a manner similar to that done by the manual operator 58.

Figure 10:
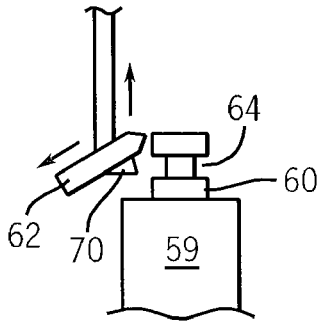
FIG. 10 is a figure similar to that of FIGS. 7-9 showing the thermal actuator fully cooled after full heating causing the disengagement of the unlocking mechanism by a stationary wedge.

Referring now to FIGS. 6 and 10, upon complete cooling of the wax motor 59, the operator 60 retracts sufficiently far to pull the angled tooth 62 against a wedge stop 70 causing the angled tooth 62 to swing leftward disengaging it from the slot 64 and allowing the angled tooth 62 and the unlocking linkage 56 to move upward under the influence of spring 54 returning to a state approximating that of FIG. 3.

It will be noted that the wax motor 59 remains generally disengaged from the bolt 32 and the unlocking linkage 56 until the operator 60 of the wax motor 59 is fully extended and then retains connection until the operator 60 is fully withdrawn. This and the abutting connection between pin 46 and unlocking lever 48 allows free movement of the bolt 32 during all but a power failure situation.

Figure 11:
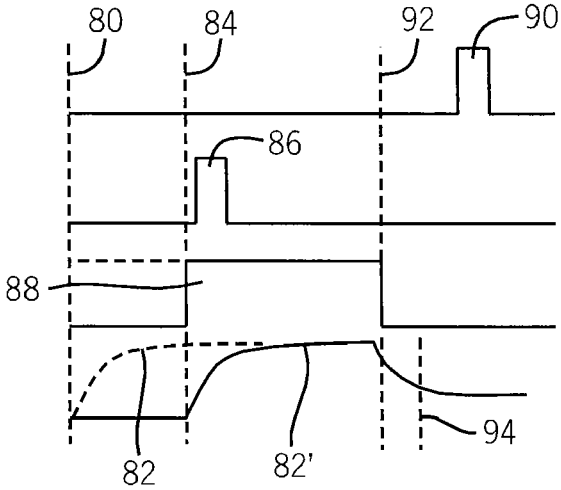
FIG. 11 is an electrical timing diagram showing various control signals that may be received by the locking assembly of the above figures.

Referring now to FIGS. 2, 3 and 11, the cycle timer assembly 30 at time 80, upon the start of the washing machine 10, may provide 110 VAC activation signal to the wax motor 59 causing its operator 60 to move upward as shown by trajectory 82. The heating process produces a time delay before the operator 60 is fully extended, yet this upward extension does not interfere with the operation of the bolt 32 but prepares the locking assembly 16 to react to power loss even before the door 12 is locked by a locking pulse 86 applied to coil 38*b* as described above.

Alternatively the cycle timer assembly 30 may wait until a time 84 to provide an activation signal to the wax motor 59, ideally slightly before but possibly completely aligned with the lock on locking pulse 86 to produce trajectory 82'. In this way, power consumption by the wax motor 59 is reduced. The activation signal 88 can remain on continuously but preferably is turned off upon application of unlocking pulse 90 to coil 38*a* by the cycle timer assembly 30.

The present invention contemplates that a power failure may occur at time 92 before the application of the unlocking pulse 90. In this case, the activation signal 88 (and other signals from the cycle timer assembly 30) derived from the power line 31 cease and the operator 60 of the wax motor 59 retracts unlocking the washing machine 10 after first delay at time 94.

It is specifically intended that the present invention not be limited to the embodiments and illustrations contained herein and the claims should be understood to include modified forms of those embodiments including portions of the embodiments and combinations of elements of different embodiments as come within the scope of the following claims.

We claim:

1. A door locking assembly for use in an appliance receiving electrical power from a power line and having a door that may be opened to provide access to a wash chamber, the door locking assembly comprising:

(a) a bi-stable electromagnetic locking mechanism adapted to move between a locked state in which the bi-stable electromagnetic locking mechanism is in a first position that holds the door closed until an electrical unlock signal is received and, an unlocked state in which the bi-stable electromagnetic locking mechanism is in a second position that allows the door to be freely opened until an electrical lock signal is received; the electromagnetic locking mechanism further adapted to remain stably in the locked state or unlocked state absent application of the electrical unlock signal or the electrical lock signal, wherein (i) the electrical lock signal is an application of electrical power that drives the bi-stable electromagnetic locking mechanism to the first position substantially simultaneously with the application of electrical power, and (ii) the electrical unlock signal is an application of electrical power that drives the bi-stable electromagnetic locking mechanism to the second position substantially simultaneously with the application of electrical power; and (b) a thermal actuator moving in response to electrical heating and cooling of an actuator component and communicating with the bi-stable electromagnetic locking mechanism, the thermal actuator attached to the power line and adapted to:

(1) store energy while the power line provides electrical power without moving the bi-stable locking mechanism and (2) use the stored energy to move the bi-stable electromagnetic locking mechanism to the unlock state when the bi-stable electromagnetic locking mechanism is in the locked state and power is lost at the power line at a predetermined delay time after the power is lost at the power line.

2. The door locking assembly of claim 1 wherein the thermal actuator stores energy only while the power line provides electrical power and a separate activation signal related to the electrical lock signal is received from a cycle timer.

3. The door locking assembly of claim 1 wherein the thermal actuator stores energy before the electrical lock signal has been received.

4. The door locking assembly of claim 1 wherein the stored energy is held in a spring flexed by thermal expansion of a material heated by electrical power terminating with loss of power from the power line.

5. The door locking assembly of claim 1 wherein the appliance is a washing machine having a spin basket and the thermal actuator unlocks the bi-stable electromagnetic locking mechanism only after a thermal delay related to a cooling of the thermal actuator, the thermal delay being of a duration sufficient to permit the spin basket to coast to a stop after power is lost at the power line.

6. The door locking assembly of claim 1 wherein the thermal actuator is a wax motor.

7. The door locking assembly of claim 6 wherein the wax motor receives a voltage from the power line.

8. The door locking assembly of claim 1 wherein the thermal actuator communicates with the bi-stable electromagnetic locking mechanism through a coupling providing engagement between the thermal actuator and the bi-stable electromagnetic locking mechanism during cooling of the thermal actuator when the electromagnetic locking mechanism is locked and providing disengagement between the thermal actuator and the bi-stable electromagnetic locking mechanism at other times.

9. The door locking assembly of claim 8 wherein the coupling provides a tooth and socket engaging each other when the thermal actuator has substantially fully stored energy and disengaging when the thermal actuator has substantially fully exhausted stored energy.

10. The door locking assembly of claim 1 further including an operator manually accessible from an outside of the door locking assembly and communicating with the bi-stable electromagnetic locking mechanism to move the bi-stable electromagnetic locking mechanism to an unlocked state when the operator is manually operated.

11. The door locking assembly of claim 1 wherein the bi-stable electromagnetic locking mechanism is a sliding bolt driven by a bi-stable solenoid.

12. The door locking assembly of claim 11 wherein the bi-stable solenoid comprises two electrically independent solenoid coils arranged in opposition about a common armature.

13. The door locking assembly of claim 11 wherein the bi-stable solenoid is not rated for continuous duty.

14. The door locking assembly of claim 1 wherein the bi-stable electromagnetic locking mechanism includes a bi-stable bolt engaging a latch.

15. The door locking assembly of claim 14 wherein the thermal actuator is a wax motor.

16. The door locking assembly of claim 1 wherein the thermal actuator has a cool down characteristic of sufficient time duration to ensure moving parts of the appliance have coasted to complete stop before the thermal actuator unlocks the locking mechanism.

* * * * *